US005903103A

United States Patent [19]

Garner

[11] Patent Number: 5,903,103

[45] Date of Patent: May 11, 1999

[54] SEQUENTIAL FLASHING FOOTWEAR

[76] Inventor: Melvin C. Garner, 111 Ridge Rd., Hartsdale, N.Y. 10530

[21] Appl. No.: 08/816,873

[22] Filed: Mar. 13, 1997

[51] Int. Cl.[6] ..... A43B 23/00; A43B 3/00

[52] U.S. Cl. ..... 315/76; 362/103; 362/183; 36/137; 36/136

[58] Field of Search ..... 315/76; 362/103, 362/183, 251, 234; 36/137, 136

[56] References Cited

U.S. PATENT DOCUMENTS

| | | |
|---|---|---|
| 1,933,243 | 10/1933 | De Merolis et al. . |
| 2,572,760 | 10/1951 | Rikelman . |
| 2,634,407 | 4/1953 | Johnson . |
| 2,671,209 | 3/1954 | Habib . |
| 2,976,622 | 3/1961 | Shearouse . |
| 3,800,133 | 3/1974 | Duval . |
| 3,893,247 | 7/1975 | Dana, III . |
| 3,946,505 | 3/1976 | Dana, III . |
| 4,014,115 | 3/1977 | Reichert . |
| 4,158,922 | 6/1979 | Dana, III . |
| 4,253,253 | 3/1981 | McCormick . |
| 4,298,917 | 11/1981 | Ware . |
| 4,412,205 | 10/1983 | Von Kemenczky . |
| 4,848,009 | 7/1989 | Rodgers ..... 36/137 |
| 5,033,212 | 7/1991 | Evanyk . |
| 5,188,447 | 2/1993 | Chiang et al. . |
| 5,285,586 | 2/1994 | Goldston et al. . |
| 5,303,131 | 4/1994 | Wu . |
| 5,343,190 | 8/1994 | Rodgers . |
| 5,353,441 | 10/1994 | Lazorchak . |
| 5,357,697 | 10/1994 | Lin . |
| 5,371,662 | 12/1994 | Shen-Ko . |
| 5,381,615 | 1/1995 | MacMillan . |
| 5,396,720 | 3/1995 | Hwang et al. . |
| 5,400,232 | 3/1995 | Wong . |
| 5,406,724 | 4/1995 | Lin . |
| 5,408,764 | 4/1995 | Wut . |
| 5,419,061 | 5/1995 | Barrocas . |
| 5,422,628 | 6/1995 | Rodgers . |
| 5,438,488 | 8/1995 | Dion . |
| 5,438,493 | 8/1995 | Tseng . |
| 5,455,749 | 10/1995 | Ferber . |
| 5,456,032 | 10/1995 | Matsumoto et al. . |
| 5,457,900 | 10/1995 | Roy . |
| 5,461,188 | 10/1995 | Drago et al. . |
| 5,463,537 | 10/1995 | Trattner et al. . |
| 5,465,197 | 11/1995 | Chien . |
| 5,477,435 | 12/1995 | Rapisarda et al. . |
| 5,477,437 | 12/1995 | Lach . |
| 5,483,759 | 1/1996 | Silverman . |
| 5,485,358 | 1/1996 | Chien . |
| 5,490,338 | 2/1996 | Hwang et al. . |
| 5,495,136 | 2/1996 | Chiang et al. . |
| 5,500,635 | 3/1996 | Mott ..... 340/323 R |
| 5,502,903 | 4/1996 | Barker . |
| 5,508,899 | 4/1996 | McCormick . |
| 5,546,681 | 8/1996 | Goldston et al. . |
| 5,566,479 | 10/1996 | Gray et al. . |
| 5,577,828 | 11/1996 | Nadel et al. . |
| 5,604,999 | 2/1997 | Barker . |
| 5,746,499 | 5/1998 | Ratcliffe et al. ..... 362/103 |

FOREIGN PATENT DOCUMENTS

| | | |
|---|---|---|
| 0 121 026 | 10/1984 | European Pat. Off. . |
| 0 335 467 | 10/1989 | European Pat. Off. . |
| 2675025 | 10/1992 | France . |
| 26 08 485 | 9/1977 | Germany . |
| 28 38 770 | 3/1980 | Germany . |
| WO 93/11681 | 6/1993 | WIPO . |

*Primary Examiner*—Don Wong
*Assistant Examiner*—Wilson Lee
*Attorney, Agent, or Firm*—Darby & Darby

[57] ABSTRACT

Flashing footwear includes at least one light source, e.g., an LED, located on an external surface of the footwear so as to be visible, such as the rear of the heel. A power source, such as a battery, provides sufficient power to light the light source to cause illumination in response to a switch actuated by the condition of motion of the footwear so as to change between open and closed positions. A circuit is combined with the battery and switch to form a module arranged in the heel of the footwear. This circuit directs power from the battery to the LED to cause the LED to illuminate for a period of time in response to a change of the switch from the closed position to the open position and/or to light continuously while the switch is closed.

36 Claims, 10 Drawing Sheets

FIG. 5A
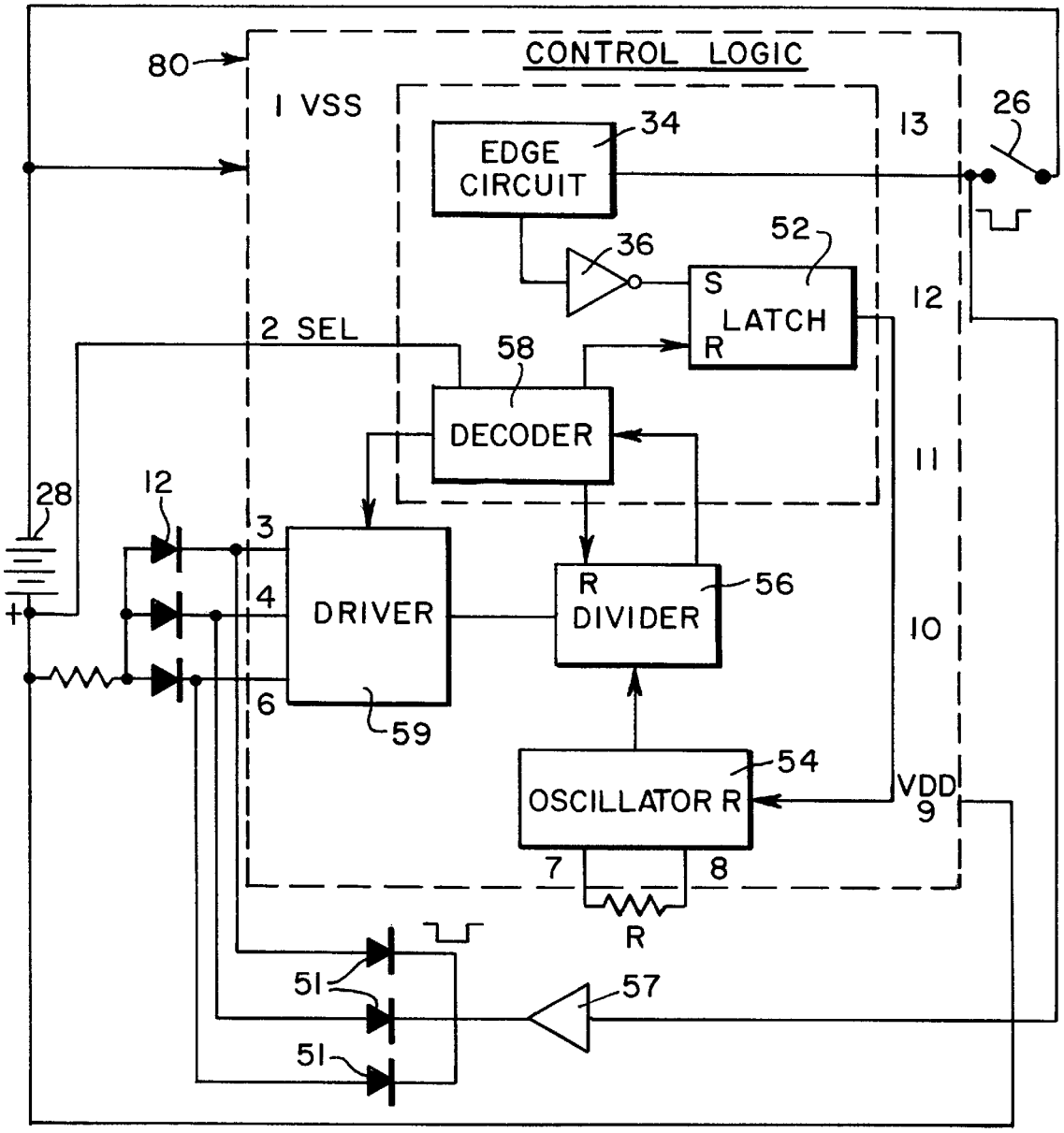
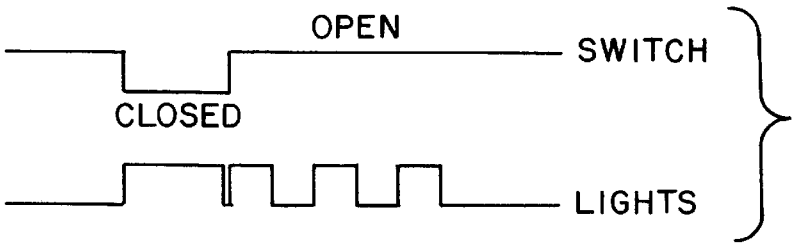
FIG. 5B

A
B
56
CKB
Q
CK
QB
TIME BASE COUNTER
91
EN
90
END
96A
96B
95
98A
98B
97
KEY
OFF
IN
D
Q
CK
R
72
F32
A
SEL
SELECT
79

SEQUENTIAL FLASHING FOOTWEAR

BACKGROUND OF THE INVENTION

The present invention relates to lighted footwear and, more particularly, to footwear with light modules that apply power from a power source in such a way as to turn on the lights so the safety of the wearer is improved, the useful life of the power source is extended and an attractive lighting pattern is created.

At various times in the past, lighted footwear has enjoyed some popularity. This lighted footwear all has the same basic components, i.e., at least one light source, a source of power for the light or lights and a switch of some sort to apply the output of the power source to the light to cause it to come on and provide illumination. The lights can be of a variety of types, e.g., incandescent bulbs, electroluminescent panels, and light emitting diodes (LEDs). These are popular lights for this purpose because they can be lighted by the power from small batteries, so that the elements lighting the light can be encapsulated in the footwear and need not be connected to any external power source. However, there is no reason that light sources which require a.c. voltage or current, such as fluorescent lights, could not be used in lighted footwear, assuming a suitable power source were provided. Consequently, as used in this application, "light source" is intended to encompass any device capable of generating detectible light, visible or otherwise, e.g., infrared.

In its simplest form lighted footwear typically has lights in the heel and along the sole of the footwear, which could be athletic, casual shoes, formal shoes or sandals for men, women or children. A battery, e.g, of three (3) volts output, is incorporated in the heel or sole of the shoe and is connected by wires to the lights. A switch is provided in the connecting wires to control the illumination of the lights, which switch may be a simple manual switch as disclosed in U.S. Pat. No. 4,158,922 of Dana, III. Thus, whenever the user wishes the lights to be on, for example, just before he or she goes jogging at night, he or she can turn on the lights by operating the switch. However, with such an arrangement the lights would be on continuously until the switch is turned off.

If the lights are flashed intermittently, there are two advantages. First, the life of the battery is increased in proportion to the time the lights are off during the intermittent flashing. Second, a more attractive eye-catching display is provided. When running at night, the flashing of the lights makes the user more visible, e.g., to motorist, so that the safety of the user is increased. One way to achieve a flashing effect is to utilize a motion-activated switch to apply power to the lights. This could be a mercury switch which is in the form of a tube containing a quantity of mercury and having spaced-apart electrical contacts. The tube is oriented on the footwear so that when the footwear is flat, there is no connection between the contacts. However, as the footwear is tilted, as during the taking of a step, the mercury runs down the tube and closes the contacts. This contact is broken again when the footwear is flat again at the completion of the step. Thus, as the user walks, the lights come on and go off. Mercury switch operated lighted footwear is disclosed in U.S. Pat. No. 4,848,009 of Rodgers and the Dana III '922 patent mentioned above.

In another form of motion-activated switch, the mercury in a mercury switch is replaced for environmental reasons with a metal ball that rolls in the tube. Further, mechanical motion activation can be achieved by the mechanical lever system disclosed in U.S. Pat. No. 2,572,760 of Rikelman. In addition, intermittent operation of the lights can be achieved by a pressure switch. During jogging, whenever the wearer's foot hits the ground the pressure activates a switch in the shoe which closes the circuit and causes the lights to flash. Such a pressure switch is disclosed in European Patent Application No. 0 121 026 of Dana III.

Another way to achieve an intermittent lighting effect is to incorporate an electronic circuit into the flashing footwear. This circuit could be an integrated circuit low frequency oscillator or flasher operated by the switch and providing the power to the lights. Whenever the switch is closed the oscillator provides power to the lights at a slow rate, e.g., from 0.5 to 2.5 Hz. Such a flasher could be like the National Semiconductor LM3909 LED Flasher/Oscillator. Use of this device to provide intermittent lighting is disclosed in the Dana III European patent application. The U.S. Pat. No. 4,158,922 of Dana III also discloses a low frequency oscillator made from individual components which is used in this fashion.

One problem with these prior motion-activated switches, e.g., the mercury, ball, lever and pressure switches, is that they can remain continuously closed, thus allowing the lights to stay on and running the battery down. For example, if shoes with the mercury, ball or lever switches are placed at an attitude corresponding to a step in walking, the switch will close and the lights will light continuously. Similarly, the shoes with the pressure switch can be packed so there is enough pressure on the switch so that these lights are on. If this happens in transit from the factory to the store shelves, the flashing effect may no longer work at the time an attempt is made to sell the product to the ultimate user or soon after the sale. This can cause customer complaints and returns of the merchandise. With the pressure switch, if the wear is merely standing in one place for too long, the lights will remain on and premature exhaustion of the battery will occur.

An electronic solution to the problem of premature battery exhaustion is disclosed in U.S. Pat. No. 4,848,009 of Rodgers. The Rodgers patent proposes that the power to light the lights be provided from the battery through a circuit. This circuit is than controlled by the switch and a further timing circuit so that when the switch closes the circuit provides power to the light and starts the timing circuit. After a predetermined period of time the timing circuit signals the power circuit to cut off the power to the lights. Power cannot be reapplied to the lights until the switch opens and closes again. This results in a single illumination of the lights for a fixed period of time in response to the closure of the switch.

An alternative arrangement for avoiding premature battery exhaustion is provided in U.S. Pat. No. 5,408,764 of Wut. The Wut arrangement uses a battery, lights and a spring switch. The spring switch is in the form of a coil of spring wire which is cantilevered over an electrical contact on a printed circuit board. The other end is also connected to an electrical contact. Whenever a jolt is given to the switch, a module containing the switch, or a shoe containing the switch, the coil of wire will swing into contact with the printed circuit board contact, thus closing the circuit and supplying power to light the lights. However, because of the spring nature of the coil, it swings back out of contact with the printed circuit board as soon as the momentum applied by the jolt is overcome. As a result the spring switch provides only intermittent contact, so it cannot apply power to the lights for a long period of time and run down the battery.

It is known to provide enhanced attractiveness to flashing footwear by providing sequential lighting of a plurality of lights instead of mere intermittent lighting. Thus, for example, if there were three lights on the shoe, each switch closure would cause them to light in sequence, as opposed to simultaneously, and the sequence could be repeated two or more times.

The Rodgers and Wut patent designs provide single illuminations of the lights when the foot hits the ground during walking or jogging. This is the position during walking or jogging when the feet are least visible. For example if the wearer is jogging in grass of even moderate height, the lights may be obscured by the grass, thus making the wearer less visible and more susceptible to danger. Thus, it would be beneficial to have lighted footwear that could provide lighting in a unique and novel sequence while the foot is raised, but still avoid the problem of premature battery exhaustion.

SUMMARY OF THE INVENTION

The present invention is directed to a system for providing unique and attractive sequential illumination of light sources on footwear, which provides enhanced safety for the wearer and avoids the problem of premature battery exhaustion, by providing circuitry that turns on the light sources in sequence when a motion-actuated switch opens after motion caused it to close.

In an illustrative embodiment of the invention the lighted footwear has the typical power source, e.g. a battery, and a motion-actuated switch, e.g. a pressure switch, located in a module which may be encapsulated in a weather resistant plastics material and secured in the heel or sole of the shoe. Wires extend from the module to connect to light sources, e.g. LEDs, located on the heel, along the sole and perhaps other portions of the shoe which are visible. In addition an electronic circuit is provided that includes a switch opening detector, which detects the opening of the switch after it has been closed, and an electronic flasher or sequencer.

With this arrangement, whenever a user of the invention is jogging and his or her foot hits the ground, the lighting or lighting sequence does not occur, because that is the point of least visibility. Instead, as the user lifts his or her foot in continuing to jog, the lighting of the light source or the lighting sequence is initiated. Thus, at the point of the maximum visibility of the shoe the lights are turned on. Further to assure that there is not premature battery exhaustion, the circuit terminates the illumination or the sequence within a fixed or random period after the switch has opened.

The period of time during which the lights are on, flash or sequence can be a fixed or predetermined period as determined by a resistor-capacitor time constant. However, it could also be random or pseudo random. Pseudo random time generators are available in the form of integrated circuits such as the Vitelic VH215 LED flasher.

The circuit for detecting the opening of the switch can be in the form of a resistor-capacitor differentiator which produces spikes of voltage whose polarity depends on whether the switch is being opened or closed. A peak detector then senses the polarity of the signal from the differentiator and triggers an intermittent or sequential flashing circuit when the signal indicates switch opening.

An intermittent flasher can produce a current pulse to light the lights simultaneously for a fix or random period of time. A sequential flasher will cause the lights to illuminate in a sequential pattern for a particular period of time. Because these circuits cease illumination in a particular or random period of time after the switch opens, the problem of battery exhaustion is eliminated for mercury, ball, lever or pressure switches.

If a spring switch is used, the power circuit can be made to apply power as long as the switch is closed, and then to cause an intermittent or sequential illumination of the lights in response to the opening of the switch. Thus, the opening of the spring switch because of its natural spring bias prevents the illumination due to the closing of the switch from continuing long enough to cause premature battery exhaustion, and the triggering of the intermittent or sequential flashing circuit with the opening of the switch also limits battery exhaustion. The combination creates a unique and attractive light pattern where, for example, all the lights light together when the switch closes, and light in sequence when the switch opens. A capacitive delay circuit can be added so that when the switch closes a sufficient pulse of current is sent to the lights to get a visible image before the spring switch opens and the sequence begins.

BRIEF DESCRIPTION OF THE DRAWINGS

The foregoing and other features of the present invention will be more readily apparent from the following detailed description and drawings of illustrative embodiments of the invention in which:

FIG. 4A is a more detailed schematic of one embodiment of a circuit for driving lights on footwear according to the present invention.

FIG. 5A is a more detailed schematic of another embodiment of a circuit for driving lights on footwear according to the present invention, and FIG. 5B is a timing diagram for that embodiment;

DESCRIPTION OF ILLUSTRATIVE EXEMPLARY EMBODIMENTS

Figure 1:
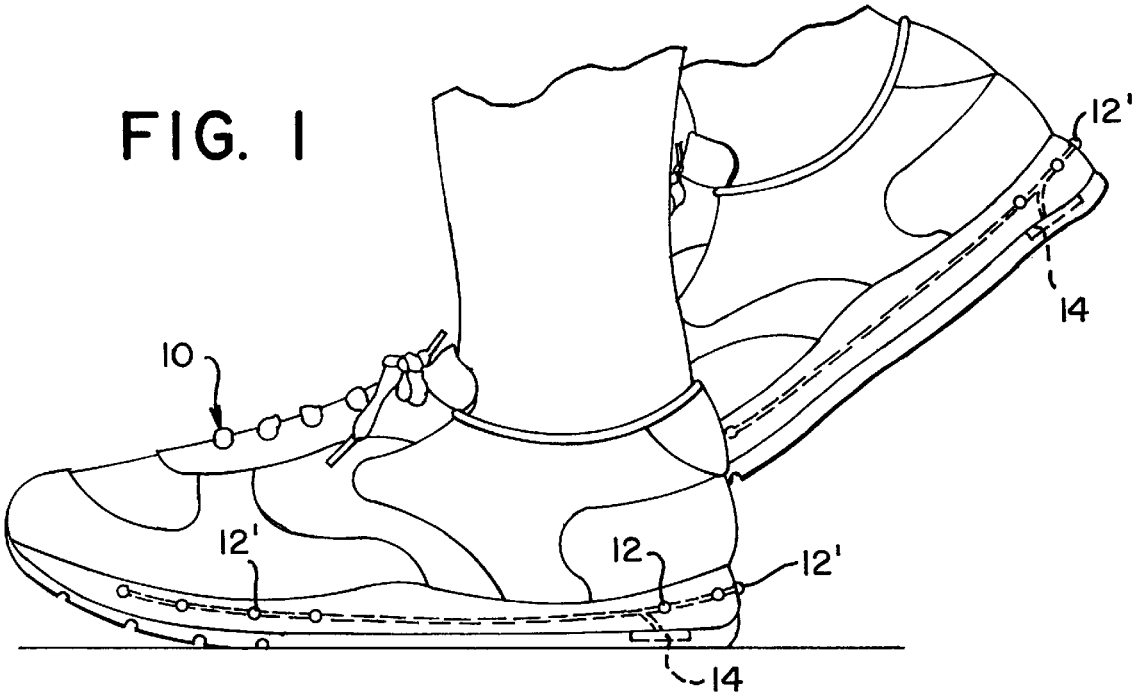
FIG. 1 shows the feet of a person walking on jogging in footwear incorporating the flashing light system of the present invention.

FIG. 1 shows a pair of athletic shoes 10 on the feet of a person walking or jogging. While athletic shoes are shown, it should be understood than any type of shoe may incorporate the present invention, such as women's high heels, men's dress shoes, boots, slippers, etc. These shoes are equipped with a plurality of light sources 12,12', e.g., light emitting diodes (LEDs). However, the lights could be any other type of light source or a mixture of several types of lights including incandescent, electroluminescent, infrared or ultraviolet. Even though infrared or ultraviolet lights may not be visible to the human eye, they may nevertheless be incorporated in the present invention because radiation from them can be detected by various instruments and they may be used to tract the wearer for the purpose of security or as part of a game.

The light sources 12,12' on the shoes 10 are shown in FIG. 1 arranged so the light 12' is on the rear of the heel of the shoe and the other lights 12 are on the toe and along the sides of the sole. They can also be located on the uppers if desired. Also more or fewer lights may be used. The light 12' on the rear of the heel is particularly useful in the present invention because it will provide the maximum visibility of the user from behind because of the lighting pattern of the present invention.

The lights receive power and are turned on by a module 14 which may be embedded in the heel of the shoes as shown in FIG. 1. Alternatively, the module 14 may be located in the sole or upper of the shoe. The module will typically contain at least a power source, e.g., a battery, and a switch for controlling the lighting of the lights. To achieve this, wires extend from the module to each of the lights and provide lighting power to them from a battery in the module.

In an arrangement according to the present invention, the module includes a switch which may be a motion sensitive switch (such as a mercury, ball, lever, spring or pressure switch). However, according to the present invention an electrical circuit, in the form of individual components or one or more integrated circuits is included in the module and acts to cause the light sources to illuminate at least based on the opening of the switch used. Assuming that a pressure switch is utilized in the module 14 of FIG. 1, the shoe on the left side of FIG. 1 would have its switch closed because of the force of the shoe striking the ground and the weight of the wearer. In the prior art this would cause the lights 12, 12' on that shoe to light. However, according to one aspect of the present invention, the closing of this pressure switch does not cause the lights to light, so they are shown as dark or filled-in circles in FIG. 1.

As the user continues to walk or jog, the user's weight is eventually removed from the shoe on the left as it is lifted to the position shown by the shoe on the right in FIG. 1. This allows the pressure switch to open. The opening of the pressure switch is detected by the circuit in module 14 and in response it generates a signal that causes the light sources 12, 12' on that shoe to light once together, flash several times together or to light in sequence. As a result the lights 12, 12' on the right shoe are shown as open circles to indicate that they are on.

Reference to FIG. 1 shows a distinct advantage of the present invention. Instead of the shoe on the right, which is in contact with the ground and less visible, having its lights illuminated as in the prior art, the shoe on the left which is raised in the air because of the walking or jogging motion of the user is the one that is illuminated. This allows the wearer to be seen more easily, thus increasing his safety. It should be noted that the light 12' at the rear of the heel of the right shoe in FIG. 1, being raised the farthest from the ground, is the most visible.

If instead of the other motion-activated switches, a spring switch is utilized, it may be advantageous in another embodiment of my present invention to illuminate the lights as long as the switch is closed and then to initiate a lighting sequence or a series of flashes when the switch is opened. This would provide a unique and attractive lighting pattern. In particular, the left shoe striking the ground would have its light sources turn on and they would be at the beginning of a lighting sequence, while the right shoe would also have illuminated lights, but they would be at the end of a lighting sequence. This would enhance the attractiveness of the shoes as well as the visibility and attendant safety of the shoes.

Figure 2A:
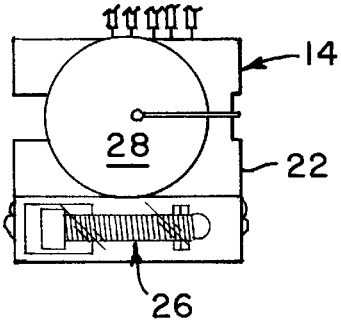
FIG. 2A illustrates a top view of the layout of a module for driving the lights of the footwear shown in FIG. 1.
Figure 2B:
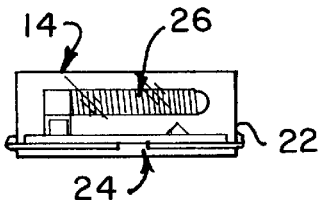
FIG. 2B is a side view thereof and FIG. 2C is a bottom view thereof.
Figure 2C:
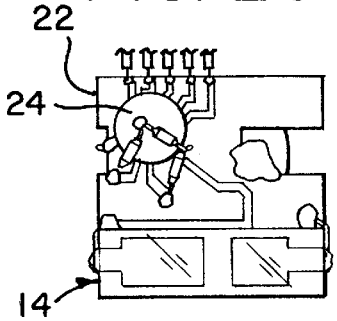

In FIG. 2 there is shown a light module 14 that includes a printed circuit board 22 having an integrated circuit 24 on its bottom side (FIG. 2C) and a spring switch 26 and battery 28 on its top side. A round watch battery 28 is shown, but cylindrical or other small batteries could be used. Also, a mercury, ball or lever switch could be substituted for the spring switch 26. If a pressure switch were used, it would be advisable to located it remote from the module so the module would not have to be subjected on a regular basis to the pressure required to close the pressure switch.

Once assembled and connected to wires intended for the lights, the module 14 can be encased in a hard plastics material to protect it from pressure, moisture and other types of damage. After it has been connected to the lights located in other parts of the shoe, the module can be located and sealed in a cavity in the heel or other convenient location on the shoe.

Figure 3:
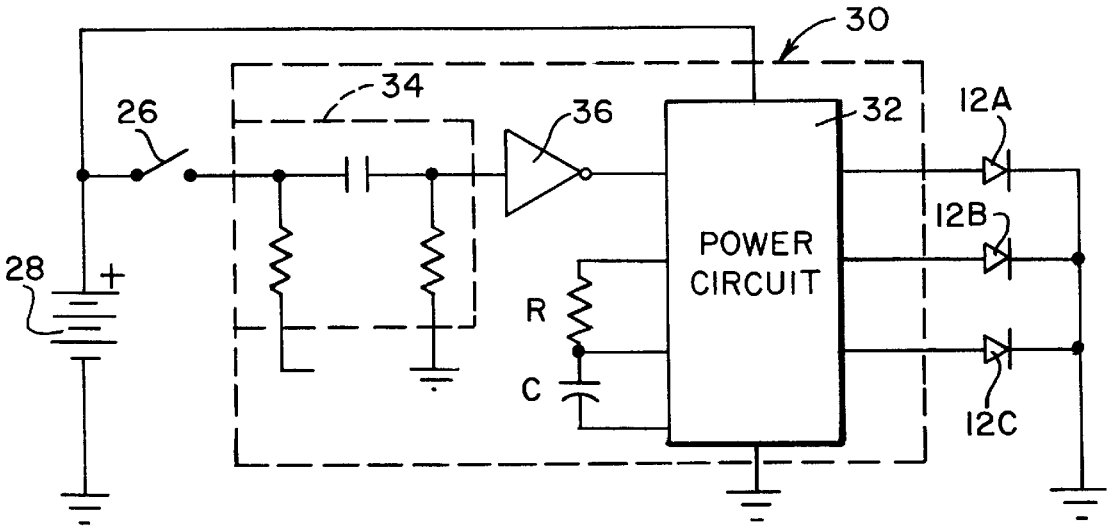
FIG. 3 is a simplified schematic of a circuit arrangement for driving the lights of footwear according to an illustrative embodiment of the present invention.

A diagram of a circuit for use in my present invention is show in FIG. 3. This circuit includes three LEDs 12 as the light sources, a battery 28 and a spring switch 26. This arrangement is controlled by a circuit 30.

The circuit 30 includes a monostable multivibrator 32 which is triggered by a positive pulse. The switch 26 is connected to the multivibrator through a differentiator circuit 34 and an inverter 36. Closure of switch 26 creates a step of positive voltage on the input to the differentiator 34 and opening the switch produces a negative step of voltage. The differentiator converts these into a positive spike of voltage indicating closure of the switch and a negative spike when opening of the switch occurs. Inverter 36 inverts the signal so that opening of the switch 26 produces a positive spike at the input of the multivibrator which triggers the multivibrator into generating an output pulse having a predetermined period of time. This pulse is used to drive the LEDs 12, which will illuminate once for a preset period determined by the resistor R and capacitor C attached to the multivibrator.

If the monostable multivibrator 32 drives a low frequency oscillator or flasher, such as a National Semiconductor LM3909, the LEDs 12 will flash simultaneously at a low rate for the predetermined time period set by the monostable 32. As an alternative, the monostable and/or the flasher can be replaced with a VH215 LED flasher made by Vitelic Limited of Hong Kong. This flasher can provide both predetermined and random flashes.

Figure 4B:
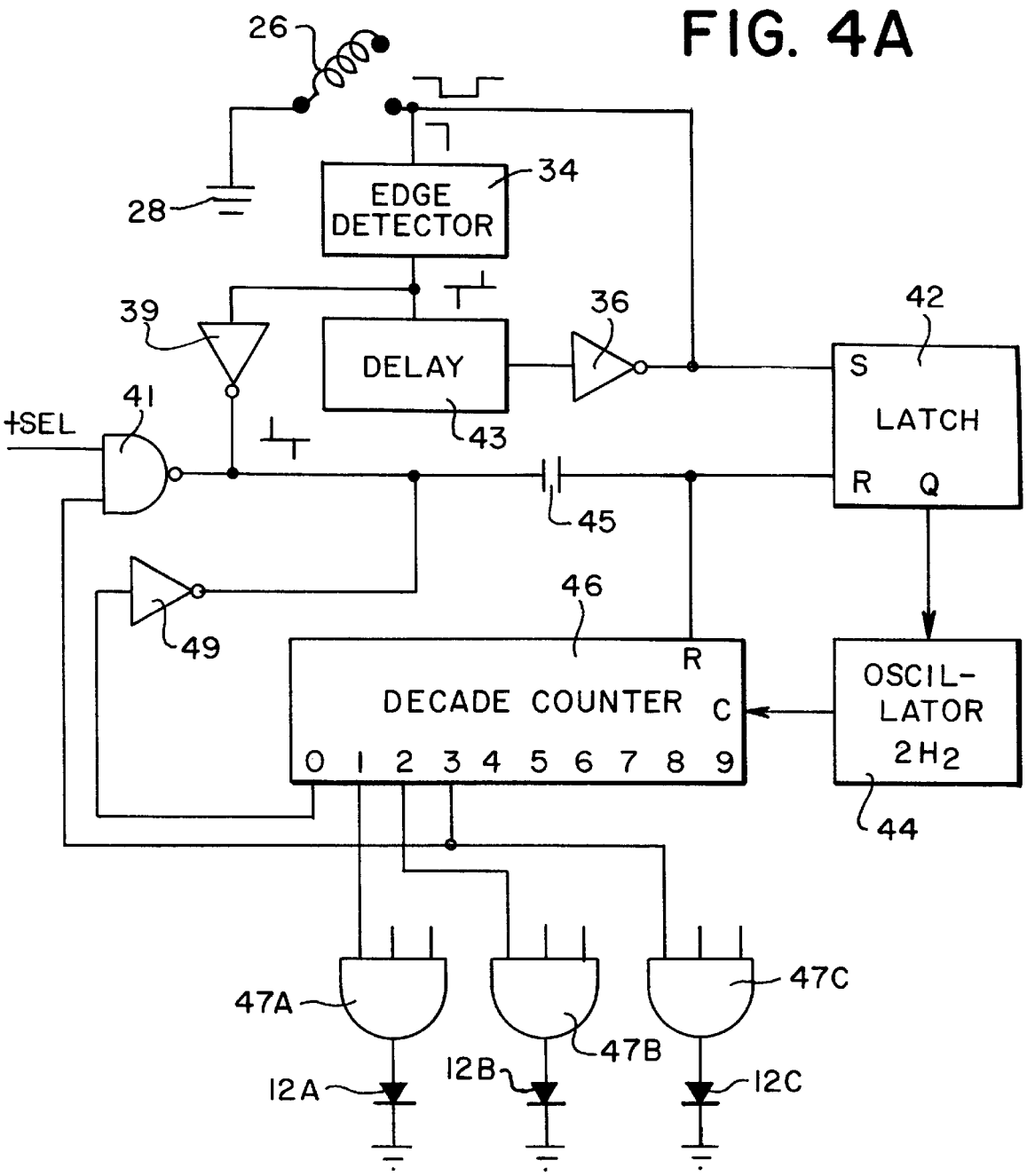
FIG. 4B is a timing diagram for that embodiment.
Figure 4B:
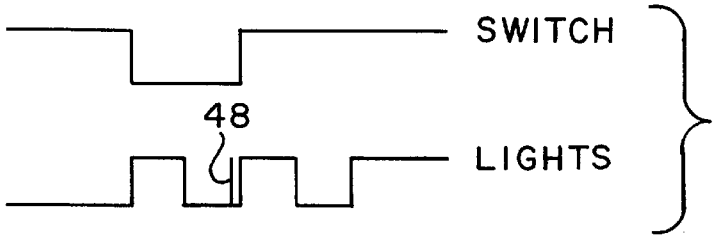

FIG. 4A illustrates a circuit that will cause multiple sequential flashes after the spring switch 26 opens. When the spring switch 26 closes, shown by a low level in the switch curve of FIG. 4B, the set input S on a latch or flip-flop circuit 42 is triggered. This produces a high level at the Q output of circuit 42 which enables a low frequency oscillator 44 which delivers pulses, e.g., at the rate of 2Hz, to decade counter 46. A group of three OR gates 47 are coupled to selected outputs of the counter 46, e.g., counts 1, 4 and 7 may be connected to gate 47A so that on those counts current will be applied to LED 12A to light it. While not shown in the drawing for the sake of clarity, counts 2, 5 and 8 are similarly connected to OR-gate 47B, while counts 3, 6 and 9 are connected to gate 47C. Since the counts are in sequence, LEDs 12A, 12B and 12C will light in sequence three times. The 0 count is applied to inverter 49 and used to reset the counter 46 and latch 42, which stops the sequence. If only one sequence is desired, the 3 count is combined with an SEL signal in NAND gate 41 to reset the counter and latch after the first sequence.

As soon as switch 26 closes, the latch 42 is in the set condition and the sequence will start and continue as long as the switch is closed, i.e., a ground level on the S input will override the reset signal applied through the capacitor 45 and the sequence will continue. This is acceptable with a spring switch, but with a pressure switch or mercury switch, this could exhaust the battery if the switch stays closed for too long.

When the switch 26 opens, the edge detector 34 produces a positive spike. This spike is first applied to inverter 39 which generates a reset pulse that resets the latch 42 and the counter 46 to stop the sequence that was started by the closing of the switch. The spike from the edge detector is also applied to delay circuit 43 which delays it so that the reset can be accomplished. The output of delay 43 is then inverted by inverter 36 to produce a negative spike that sets the latch again. As a result a new single or multiple sequence is initiated based on the opening of the switch. This sequence will continue until completed by a reset signal to the latch from gate 41 or inverter 49.

As shown in FIG. 4B, when the switch closes the sequence starts as a result of the direct connection from the switch to the latch set input S. Since the switch, if it is a spring switch, will likely open quickly after it closes, only a single sequence or three sequences, depending on the SEL signal, would be visible. When the switch opens, this sequence is terminated as shown by the small positive spike 48 in FIG. 4B. This then starts a new sequence which continues for a predetermined or random period of time based on the opening of the switch. Thus, when the switch is closed the LEDs sequence, and when the switch opens a new terminating sequence begins.

FIG. 5A is a schematic of an alternative sequential lighting circuit which could be implemented with as an integrated circuit. Shown in dotted line 50 in FIG. 5A is a circuit similar to a model 8533 integrated circuit made by Sunwave Development Limited of Hong Kong. The 8533 circuit has a latch 52 which enables an oscillator 54 in response to an input from an edge detector 34. Thus, whenever the input to the edge detector on pin 13 of the IC is grounded, the IC starts a sequence. As with the arrangement in FIG. 4A, the oscillator produces signals that are counted in divider 56. The resistor R connected to the oscillator 54 sets the frequency of the oscillator. The divider outputs are decoded in decoder 58 and used to activate drivers 59 that illuminate LEDs 12. The decoder 58 also resets the latch 52 after one or more sequences, depending on the SEL switch input to pin 2 of the IC 50.

In order to implement the present invention, the IC 8533 is modified to include the inverter 36 in the control logic after the edge circuit 34 so the latch will be triggered (set) by the opening of the spring switch instead of the closing of the switch. In addition, an amplifier 57 and three regular diodes 51 have been added. As long as the switch 36 is held closed, the amplifier 57 puts a low level at the diodes 51 which creates a current path from the positive terminal of the battery 26, through each of the LEDs 12A–12C and the diodes 51 to the low level at the output of the amplifier 58. This current keeps the LEDs on for as long as the switch is held closed. This illumination is continuous, not flashing, and is shown in the first part of the curves of the switch in FIG. 5B.

When the switch 26 opens, the edge detector 34 and the inverter 36 set the latch 52 so the sequence will began and run its course. At the end of the sequence, the decoder 58 produces a reset signal that resets the latch and stops the sequence. While this sequence may have a predetermined time, it turns off based on the transition of the switch from "on" to "off" and not from "off" to "on." Thus, the illumination will occur on the foot that is being raised in the air and is most visible. This is the second half of the timing diagram for the lights in FIG. 5B.

It may be possible to incorporate the amplifier 57 and diodes 51 into a custom integrated circuit along with the rest of the elements. Also, it should be noted that typically the switch, if it is a spring switch, will stay closed only a short period of time. Therefore, typically only the three flashes at the end of the timing diagram would be easily visible.

Figure 6A:
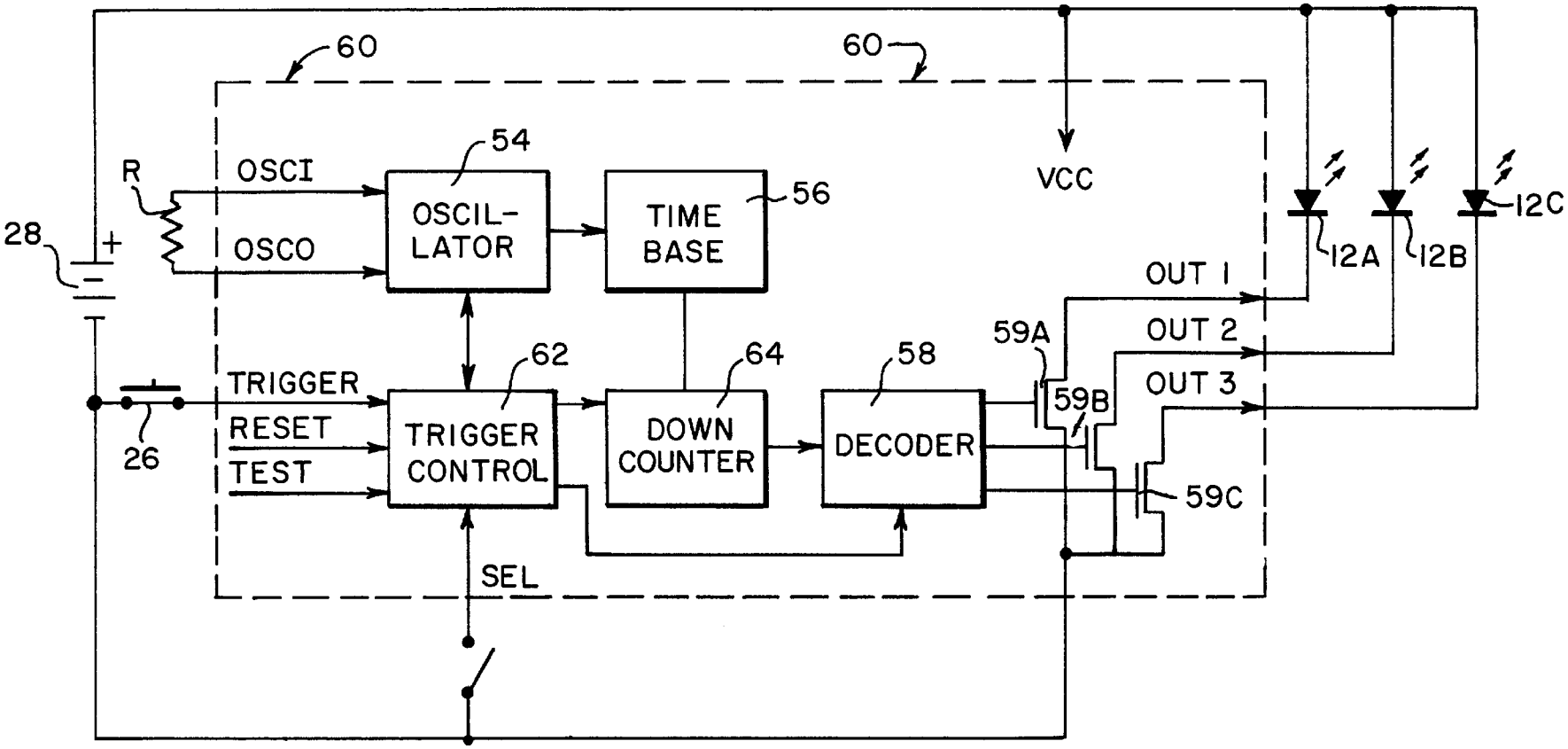
FIG. 6A is a block diagram of an integrated circuit for driving lights on footwear according to the present invention.

The circuit of FIG. 6A is another arrangement for carrying out the invention that could be implemented as an integrated circuit 60. Parts which perform a similar function in FIG. 6A to that in FIG. 5A are given the same reference number. In this arrangement an oscillator, e.g., operating at 50 kHz, has its frequency set by an external resistor R. The oscillator is turned on and off by a trigger control 62 in response to the operation of switch 26.

When the switch 26 is closed the trigger control applies a signal to decoder 58 to cause all of the driver transistors 59 to turn on and light the LEDs 12. This is shown as portions A of the OUT curves in FIG. 6B. When the switch opens, a sequence is started that first lights light 12A, (B in FIG. 6B) and then lights LEDs 12B and 12C in sequence as shown by C and D in FIG. 6B. Even if the switch opens and closes again during the sequence, i.e., E in FIG. 6B, the sequence continues uninterrupted to its completion.

Figure 6B:
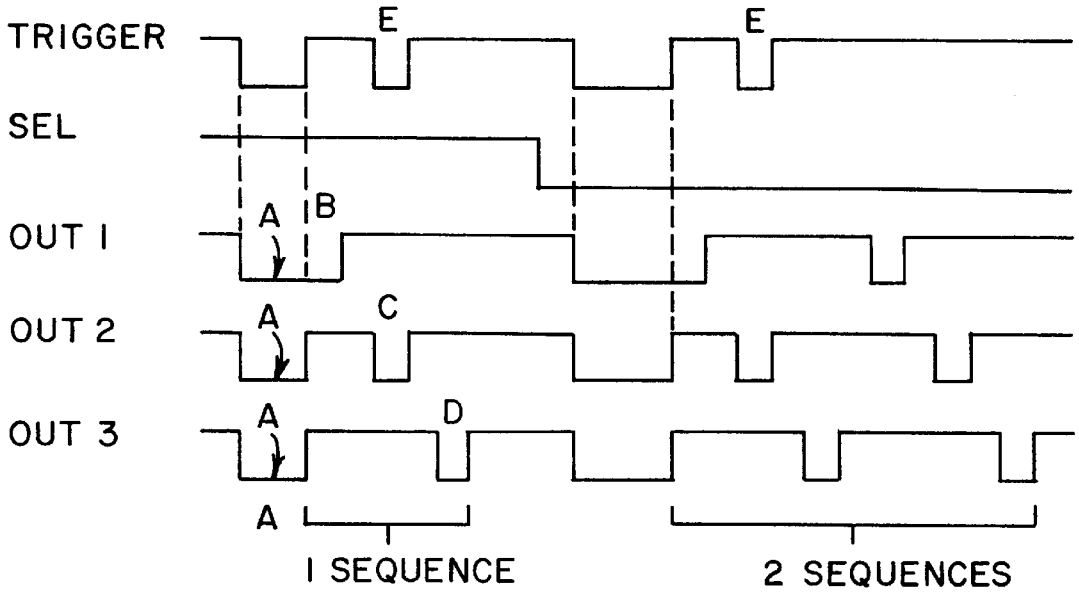
FIG. 6B is a timing diagram for that embodiment.

If the SEL switch is closed so that it is a low level, the sequence will repeat once for a total of two as shown in the last half of the curves of FIG. 6B.

To create the sequence the oscillator 54 generates the 50 kHz signal which is counted down in time base counter or divider 56. When the switch opens the trigger control allows the down counter 64 to count the output of the time base divider. This count is decoded by decoder 58 and used to operate driver transistors 59A–59C in sequence.

Figure 7C:
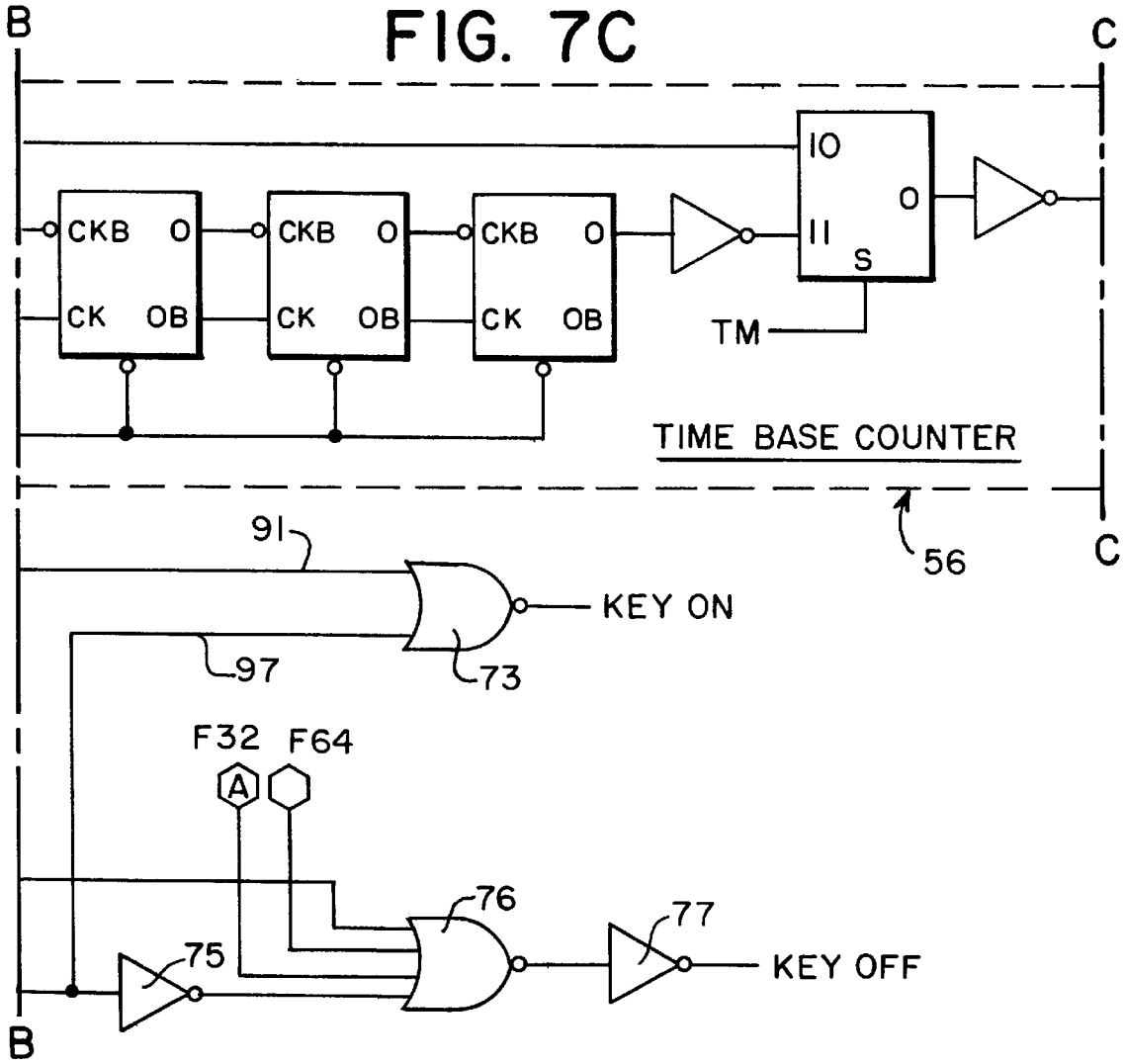
FIGS. 7A–7E form a detailed schematic for the integrated circuit of FIG. 6A.

The details of an integrated circuit which could function as integrated circuit 60 in FIG. 6A are shown in FIGS. 7A through 7E. A timing diagram for this circuit is shown in FIG. 8.

The circuit of FIG. 7 has three states. In a first state the oscillator 54 is disabled by an EN signal and the system is waiting for a trigger signal from switch 26. When the IN signal from switch 26 goes low, the oscillator is enabled by the trigger control and produces a KEY ON signal. This puts the circuit in a second state.

In the second state all of the LEDs are turned on while the switch 26 is closed. When the IN signal goes high, indicating that the switch has opened, the KEY ON signal ends and a KEY OFF signal is generated. This puts the circuit in a third state.

While in the third state the trigger control will not accept any more IN trigger signals. If the SEL signal is high, the down counter 64 produces an END signal after it counts from 3 to 1. If the SEL signal is low, the down counter will produce an END signal only after it has counted down from 3 to 1 twice. The END signal puts the circuit back into the first state again to await another IN signal.

Figure 7A:
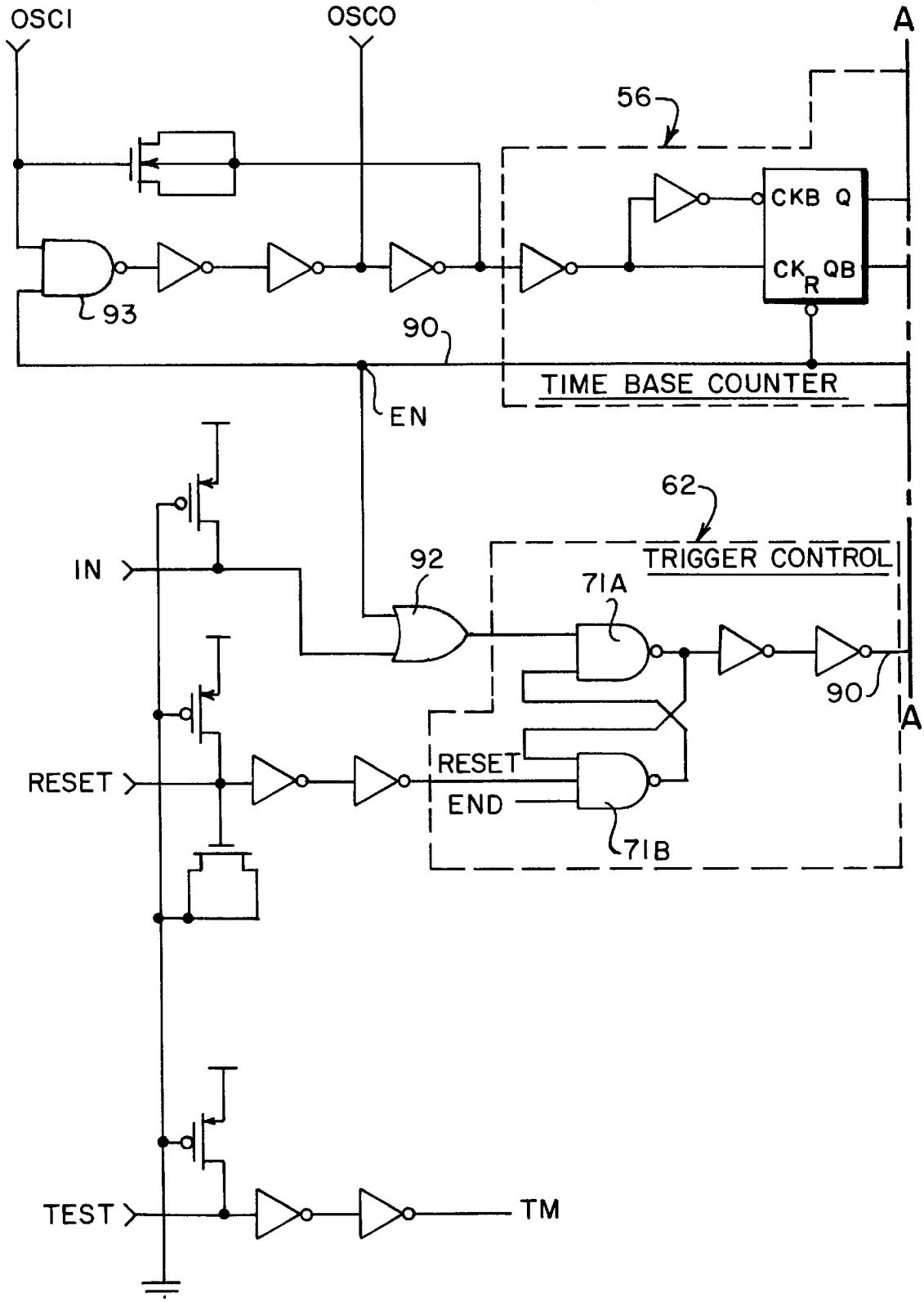
Figure 7B:
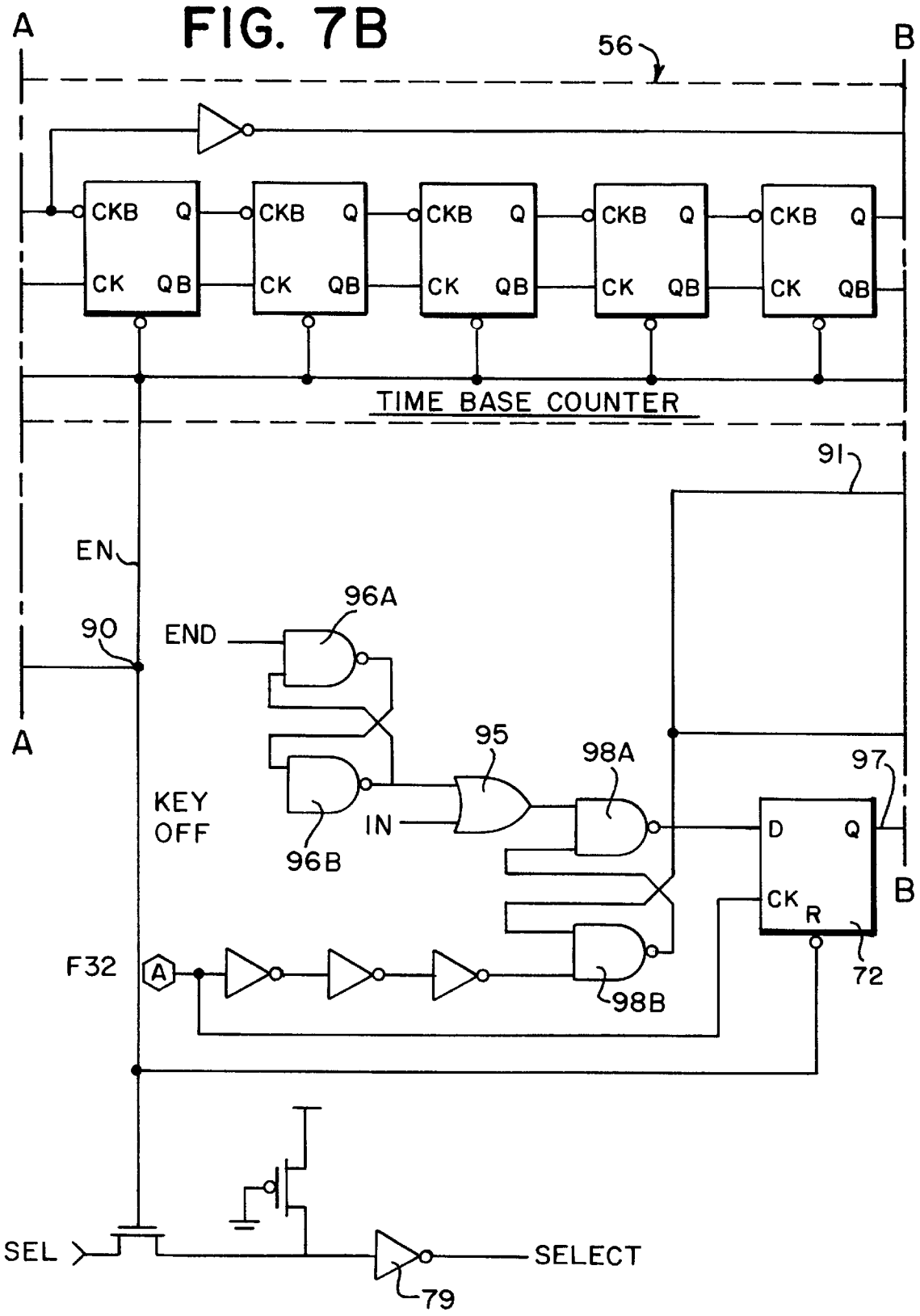
Figure 8:
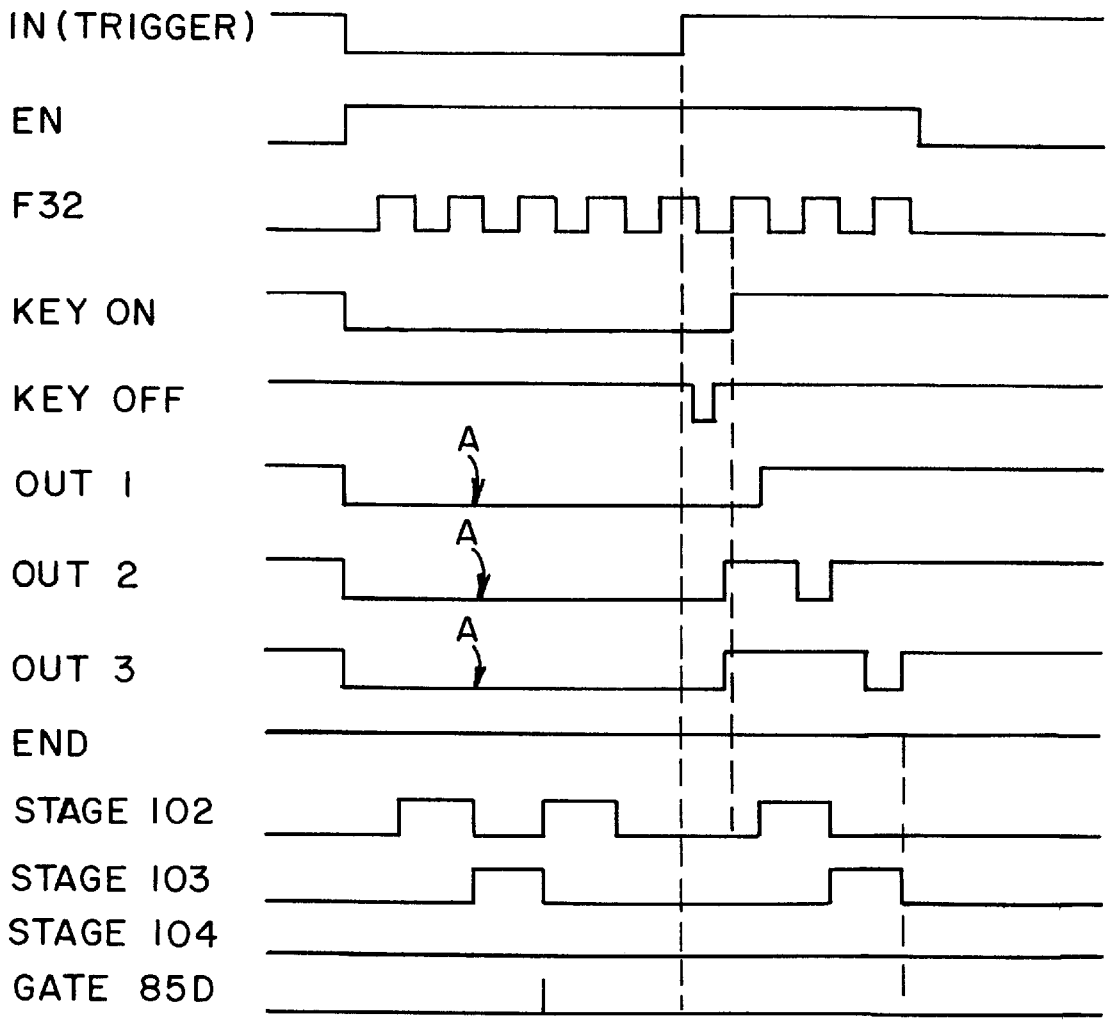
FIG. 8 is a timing diagram for the circuit of FIG. 7.

In particular at the end of a sequence with the circuit of FIG. 7A, (i.e. the third state) a low level END signal is created. This is applied to an input of NAND-gate 71B which forms part of a flip-flop or latch circuit 71 in the trigger control 62. As a result, the output of NAND-gate 71B is forced high. At the same time the switch 26 is open, so the signal IN is also high. Thus, OR-gate 92 has a high output which is applied to one input of NAND-gate 71A. The other input of NAND-gate 71A receives the high output of NAND gate 71B, so the output of gate 71A is low. This puts a low level reset or EN on line 90, (FIG. 7B) which resets the time base counter 56 and locks up the oscillator 54 by inhibiting NAND-gate 93 (FIG. 7A). While, the low level on line 90 is also applied to OR-gate 92, its output remains high because of the high IN level on its other input. Similarly, the EN signal sets a flip-flop or latch 96 comprised of gates 96A, 96B, so there is a low level at the output of gate 96B (FIG. 7B). This is state one of the circuit.

When switch 26 is closed, a low level signal IN is created at the input to OR-gate 92 (FIG. 7A), which together with the low input to this gate from line 90 (EN), creates a low input to gate 71A that sets the RS flip-flop or latch 71 so that the output of gate 71A is high and so is the reset line 90. Thus, the counter and oscillator are no longer blocked. This is state two of the circuit.

Figure 7D:
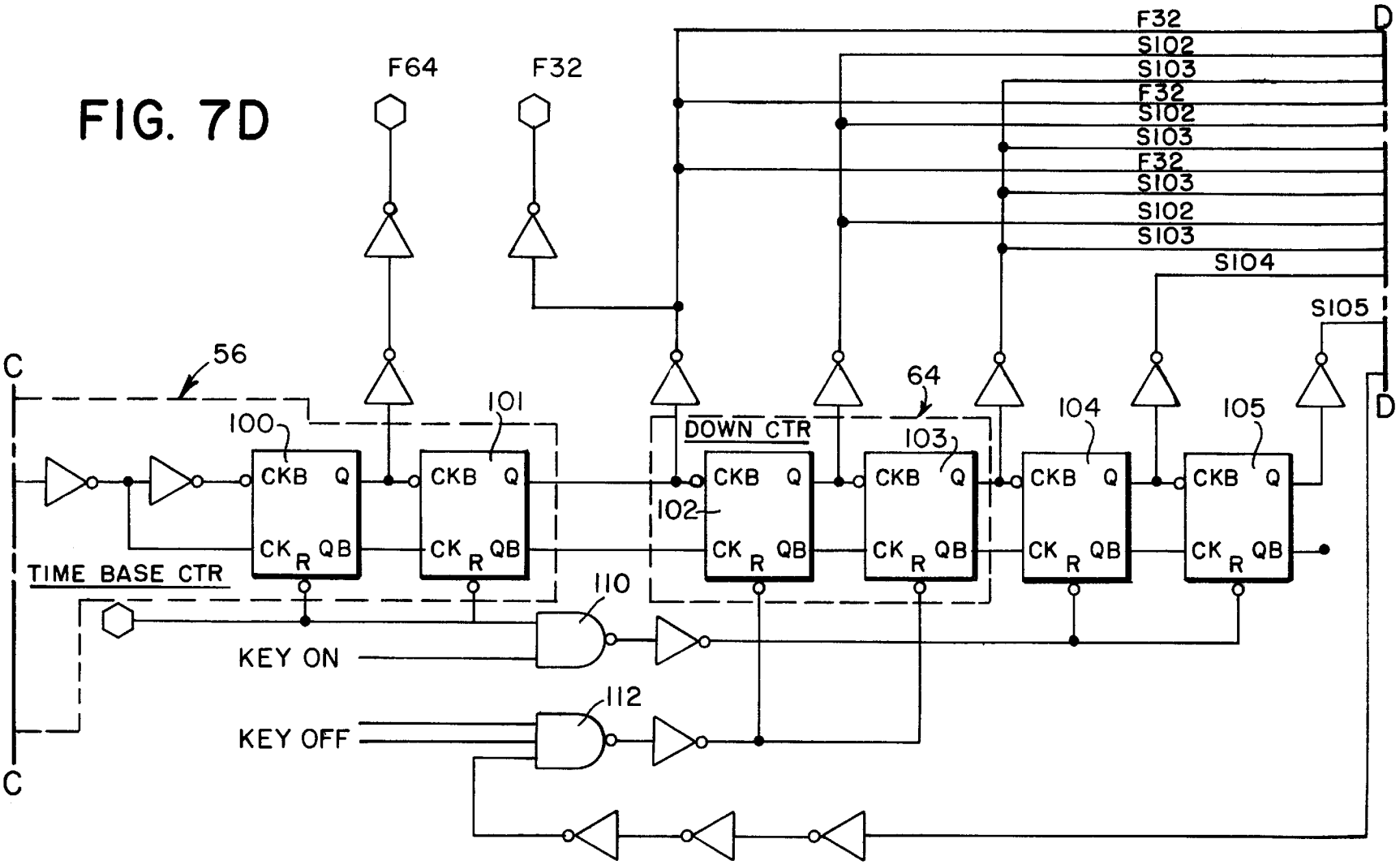

While in state two, the low IN signal is also applied to one input of an OR-gate 95 along with the low signal from gate 96B (FIG. 7B). The result is a low input to gate 98A of latch or RS flip-flop 98. This causes the output of gate 98A to be high, which high level is applied over line 91 to one input of NOR-gate 73 (FIG. 7C). This high signal is also clocked from line 93 to the Q output of D flip-flop 72 by a signal F32 from gate 101 of time base counter 56 (FIG. 7D). The Q output of flip-flop 72 (line 97) is also applied to NOR gate 73 to create a low signal KEY ON (FIG. 7C) that is at the output of NOR-gate 73 (FIG. 7C).

Figure 7E:
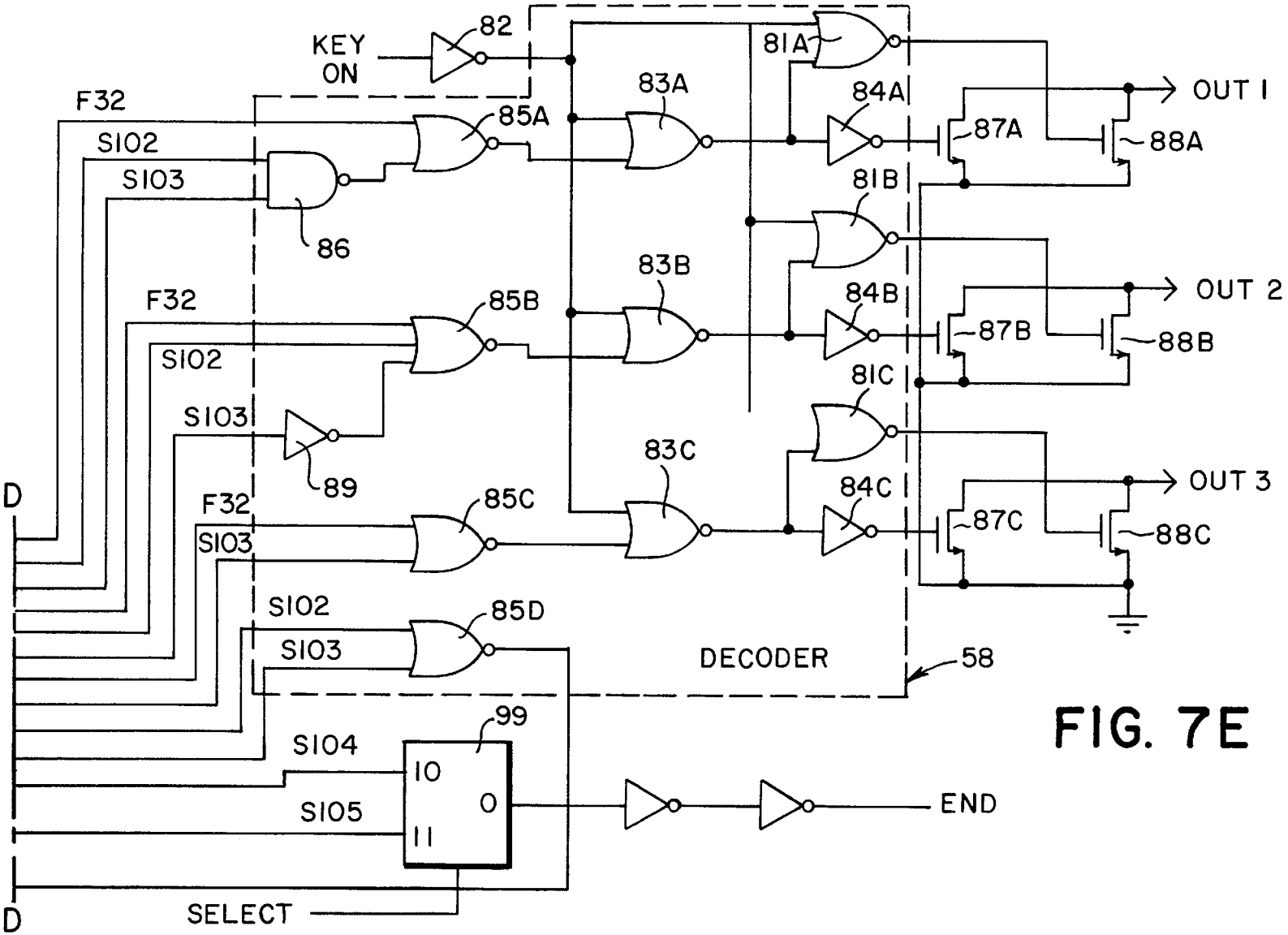

Referring to FIG. 7E, the KEY ON signal is inverted to a high level by inverter 82. This high level is converted into low level signals by each of gates 83A–83C, which in turn are converted into high level signals by inverters 84A–84C and are used to turn on driver transistors 87A–87C. These transistors cause the LEDs 12A–12C to light together for as long as the switch 26 is closed. Signals OUT1, OUT2 and OUT3 at portion A in FIG. 8 are these signals. Thus, it does not matter that the oscillator and counter are running. In this state two, transistors 88 are off to save on battery power.

When switch 26 opens the IN signal goes high. See FIG. 8. This allows latch 98 (FIG. 7B) to be reset by a version of the F32 signal from the counter which has been delayed by having to pass through three inverters at the input to gate 98B. This applies a low level on line 91 while the output on line 97 remains high. This level is inverted by inverter 75. When F32 and F64 are low, gate 76 produces a high level that is inverted by gate 77 to provide a low KEY OFF signal (FIG. 8). Thus the KEY OFF signal is low for half a clock signal of F64, i.e. when all of the inputs to gate 76 are high. The low KEY OFF signal resets latch 96. The next F32 signal clocks the low level at gate 98A into the D flip-flop 72 so the KEY OFF signal will not go high again with the next F32 and F64 signals. Thus, the inverters at the input to latch 98 eliminate a race condition. Resetting latch 98 makes the output of NAND-gate 98A low, which in turn makes the KEY ON signal high and shuts off driver transistors 87A–87C. In effect, inverter 75 and NOR gate 76 combine to form a rising edge detector to produce a KEY OFF pulse indicating that the switch has opened (FIG. 8).

As shown in FIG. 7D, the down counter 64, comprised of flip-flops 102 and 103, is reset through NAND-gate 112 by the KEY OFF signal, so the counting by that counter, which sets the timing of the sequence, does not start until the switch opens some random time after it closed. The down counter 64 counts clock pulses from time base counter 56 when the switch 26 opens. It counts down 3, 2, 1, 0. This is the third state of the circuit.

The state of down counter 64 is decoded by a series of NOR-gates 85A–85D, inverter 89 and NAND-gate 86. High outputs from the NOR-gates 85 are passed through NOR-gates 83 and NOR-gates 81 to transistors 88A–88C in sequence according to the decoded signals, so as to drive the three LEDs in sequence. The low signal from NOR-gate 83 also drives transistors 87A–87C through inverters 84. Thus, during the sequence in the third state, both transistors 87 and 88 drive the LEDs according to the following table.

| STAGE 102 | STAGE 103 | F32 | OUTPUT |
|---|---|---|---|
| 0 | 0 | 1 | 85A |
| 1 | 0 | 1 | 85B |
| 0 | 1 | 1 | 85C |
| 1 | 1 | X | 85D |

Counter stages 104 and 105 aid in determining whether there is one sequences or two. These stages are reset by the KEY ON signal through gate 110. The SEL signal of FIG. 7B is used to generate a SELECT signal from inverter 79, which controls selector switch or multiplexer 99 (FIG. 7E) so as to generate the END signal either after a first sequence when the output of stage 104 is passed through selector 99 to form the END signal or after a second sequence when the output of stage 105 is chosen by selector 99 to generate the END signal. The END signal stops the sequence a predetermined time after the switch opened to release the reset from Down Counter 64. It also returns the circuit to state one to await the next closing of the switch 26.

If the footwear according to the present invention is equipped with infrared or ultraviolet radiation light sources which are not readily visible to the human eye, they could be made visible by infrared or ultraviolet sensors or goggles, e.g., as part of a game.

While the invention has been particularly shown and described with reference to preferred embodiments thereof, it will be understood by those skilled in the art that various changes in form and details may be made therein without departing from the spirit and scope of the invention.

I claim:

1. Footwear incorporating a lighting system comprising:

at least one light source located so as to be visible at an external surface of the footwear, said light source providing electromagnetic radiation illumination when turned on;

a power source capable of providing sufficient power to said light source to cause it to provide the electromagnetic radiation illumination;

a switch actuated by the condition of motion of said footwear to change between open and closed positions; and a circuit arranged to supply power from said power source to said light source to cause said light source to illuminate for a period of time in response to a change of the switch from the closed position to the open position.

2. The footwear of claim 1 wherein the period of time is predetermined.

3. The footwear of claim 1 wherein the period of time is pseudo random.

4. The footwear of claim 1 wherein at least some of the light sources are light emitting diodes.

5. The footwear of claim 4 wherein at least some of the light sources are electroluminescent panels interspersed with the light emitting diodes.

6. The footwear of claim 1 wherein said light source is at least one of incandescent, fluorescent, infrared, ultraviolet or light emitting diode sources of electromagnetic radiation illumination.

7. The footwear of claim 1 wherein at least one light source is located on the rear of the heel of the footwear.

8. The footwear of claim 1 wherein said power source is a battery.

9. The footwear of claim 8 wherein said power source, switch and circuit form a module located in the heel of the footwear.

10. The footwear of claim 1 wherein said switch is one of a pressure switch, mercury switch, ball switch, lever switch or spring switch.

11. The footwear of claim 1 wherein said switch is a spring switch and wherein said circuit further supplies power from said power source to said light source for as long as said spring switch is in the closed position.

12. The footwear of claim 1 wherein said circuit supplies power for a single illumination of said light source after the switch changes from the closed position to the open position.

13. The footwear of claim 1 wherein said circuit supplies power for a plurality of illuminations of said light source after the switch changes from the closed position to the open position.

14. The footwear of claim 1 wherein there are a plurality of light sources and said circuit supplies power for a plurality of simultaneous illuminations of said light sources after the switch changes from the closed position to the open position.

15. The footwear of claim 1 wherein there are a plurality of light sources and said circuit supplies power for at least one sequential illumination of each of said light sources after the switch changes from the closed position to the open position.

16. The footwear of claim 1 wherein there are a plurality of light sources and said circuit supplies power for a plurality of sequential illuminations of each of said light sources after the switch changes from the closed position to the open position.

17. The footwear of claim 1 wherein said circuit includes a detector for detecting when the switch changes from the closed to the open positions, said period of time being set independent of the detector.

18. The footwear of claim 17 wherein said detector is a differentiator connected to the switch and a polarity detector connected to the output of the differentiator.

19. A light source control circuit for controlling the application of power from a power source to a light source in response to actuation of a switch, comprising:

a detector circuit which detects the opening and closing of the switch and produces a switch opening signal in response to the opening of the switch; and a power circuit, which for some period of time set by said power circuit, provides power from said power source to said light source in response to the switch opening signal so as to cause said light source to illuminate for that period of time.

20. The circuit of claim 19 wherein the period of time is predetermined.

21. The circuit of claim 19 wherein the period of time is pseudo random.

22. The circuit of claim 19 wherein the detector circuit is a differentiator circuit in series with a level detector.

23. The circuit of claim 22 wherein the power circuit is a monostable multivibrator.

24. The circuit of claim 19, wherein said light source is a plurality of light sources and said power circuit comprises:

a latch circuit set by a signal applied through the switch;

an oscillator enabled when the latch circuit is set;

a divider circuit that counts the output of said oscillator and produces further outputs related to the state of the count; and a first gate circuit for receiving the outputs of the divider and driving said plurality of light sources in sequence in response thereto, said gate circuit further providing a reset signal at the end of a sequence that resets the latch circuit when the switch is open so that the ground is no longer applied to set the latch.

25. The circuit of claim 24 further including a second gate circuit which receives a select signal at one input and an output of the divider which is less than the output for a full sequence at the other input, said gate producing a reset signal for said latch when there is coincidence between the signals applied to the gate inputs.

26. The circuit of claim 25 wherein said second gate circuit produces a reset signal for said divider when there is coincidence between the signals applied to the gate inputs.

27. The circuit of claim 24 wherein the first gate circuit includes a plurality of gates with outputs connected to respective ones of said plurality of light sources and inputs connected to multiple outputs of said divider.

28. The circuit of claim 26 wherein the light sources are light emitting diodes, said first gate circuit is a decoder for the divider circuit, and further including driver transistors for drawing current through respective ones of said light emitting diodes depending on the decoder output.

29. A light source control circuit for controling the application of power from a power source to a plurality of light sources in response to actuation of a switch, comprising:

a gate circuit connected to said switch, said gate circuit having outputs connected to the respective light sources, said gate circuit causing said light sources to illuminate while said switch is closed;

a detector circuit which detects the opening and closing of the switch and produces a switch opening signal in response to the opening of the switch;

a latch circuit set by the switch opening signal;

an oscillator enabled when the latch circuit is set;

a divider circuit which counts the output of said oscillator and produces outputs related to the state of the count;

a decoder circuit that produces outputs related to the state of the count of said divider; and a driver circuit which applies current to the light sources in sequence in response to the outputs of the decoder and further provides a reset output at the end of a sequence that resets the latch circuit.

30. The circuit of claim 19 wherein said switch is one of a pressure switch, mercury switch, ball switch, lever switch or spring switch.

31. The circuit of claim 29 wherein said switch is one of a pressure switch, mercury switch, ball switch, lever switch or spring switch.

32. The circuit of claim 29 wherein said detector is a differentiator connected to the switch and a polarity detector connected to the output of the differentiator.

33. Footwear including an upper, a sole and a lighting module comprising:

at least one light source located so as to be visible at an external surface of the footwear, said light source providing electromagnetic radiation illumination when turned on;

a power source capable of providing sufficient power to said light source to cause it to provide the electromagnetic radiation illumination;

a switch normally biased into an open position and actuated by the condition of motion of said footwear to change between the open position and a closed position; and a circuit arranged to supply power from said power source to said light source to cause said light source to illuminate for as long as said switch is in the closed position and to further illuminate for a period of time in response to a change of the switch from the closed position to the open position.

34. The footwear of claim 33 wherein the light source is a light emitting diode, the power source is a battery and the switch is a spring switch.

35. The footwear of claim 33 further including an oscillator and wherein the illumination upon opening of the switch is a sequence of illuminations controlled by said oscillator.

36. A lighting system comprising:

at least one light source located so as to be visible, said light source providing electromagnetic radiation illumination when turned on;

a power source capable of providing sufficient power to said light source to cause it to provide the electromagnetic radiation illumination;

a spring switch normally biased into an open position and actuated by one of motion and force applied to it so as to change between the open position and a closed position; and a circuit arranged to supply power from said power source to said light source to cause said light source to illuminate for as long as said spring switch is in the closed position and to further illuminate for a period of time in response to a change of the switch from the closed position to the open position.

* * * * *